United States Patent [19]

Gregersen

[11] Patent Number: 4,915,429

[45] Date of Patent: Apr. 10, 1990

[54] GATE LATCH

[76] Inventor: Randy R. Gregersen, P.O. Box 1624, 6602 County Rd. 24.2, Cortez, Colo. 81321

[21] Appl. No.: 332,765

[22] Filed: Apr. 3, 1989

[51] Int. Cl.[4] ..... F05C 17/12

[52] U.S. Cl. ..... 292/113; 292/247

[58] Field of Search ..... 292/247, 248, 113, 106, 292/66

[56] References Cited

U.S. PATENT DOCUMENTS

| | | | |
|---|---|---|---|
| 889,492 | 6/1908 | Thompson | 292/247 |
| 1,063,151 | 5/1913 | Wiltse | 292/247 X |
| 1,264,120 | 4/1918 | Neiss | 292/247 |
| 1,391,578 | 9/1921 | Powell | 292/247 |
| 1,392,934 | 10/1921 | Glandt | 292/247 |
| 1,421,573 | 7/1922 | Schaefer | 292/247 |
| 1,458,664 | 6/1923 | Schaefer | 292/247 |
| 2,548,367 | 4/1951 | Harris . | |
| 2,613,972 | 10/1952 | Gifford . | |
| 3,847,425 | 11/1974 | Kirk | 292/247 |
| 3,891,254 | 6/1975 | Lile . | |
| 4,683,934 | 8/1987 | Salsness . | |

FOREIGN PATENT DOCUMENTS

| | | | |
|---|---|---|---|
| 478090 | 10/1951 | Canada | 292/247 |
| 534471 | 12/1956 | Canada | 292/247 |
| 543175 | 7/1957 | Canada | 292/247 |
| 548227 | 11/1957 | Canada | 292/247 |

*Primary Examiner*—Eric K. Nicholson

*Attorney, Agent, or Firm*—Jerry T. Kearns

[57] ABSTRACT

A gate latch for use in releaseably securing a moveable post of a gate to a stationary fence post includes a first ring member secured at a bottom end of the stationary fence post and dimensioned for insertion of a bottom end of the moveable gate post. A mounting bracket is secured on a vertically extending sidewall of the stationary post and a pair of spaced parallel horizontally extending support members extend laterally outwardly therefrom. The body portion of a latch bar is pivotally mounted between the support members. The latch bar includes an elongated lever extending from a first side of the body portion and a transverse leg member connected to an opposite side of the body portion. A first end of the transverse leg member is provided with a plurality of apertures and an elongated strut is pivotally secured at an opposite side of the transverse leg member. A second member is secured on a distal end of the elongated strut and is dimensioned to be received over a top end of the moveable gate post. A retaining pin is provided for insertion through one of the apertures in the transverse leg member to retain the latch bar in a latched position.

1 Claim, 3 Drawing Sheets

GATE LATCH

BACKGROUND OF THE INVENTION

1. Field of the Invention

The present invention relates to gate latches, and more particularly pertains to an improved gate latch particularly designed for use with barbed wire type fences in which a moveable post of a gate is required to be secured adjacent a stationary fence post. These types of barbed wire fences utilize an inexpensive gate construction in which the gate is moveable by virtue of the flexible nature of the barbed wire. While this results in an inexpensive gate construction, it requires a relatively large amount of force to stretch the barbed wire to properly close the gate. In the most rudimentary form, this type of barbed wire gate utilizes wire loops secured at bottom and top ends of the stationary fence post which are dimensioned for insertion of the bottom and top ends of the moveable gate post. To close the gate, the bottom end of the gate post is inserted in the wire loop and the upper end of the gate post is then pushed forcefully toward the stationary fence post, stretching the barbed wire to a tensioned condition, and a second wire loop secured to the upper end of the fence post is slipped over the top end of the gate post. In order to minimize the amount of force required to properly close this type of gate, the present invention provides a mechanical lever actuated gate latch for providing a mechanical advantage to allow closing and stretching of the barbed wire gate with a minimum of effort.

2. Description of the Prior Art

Various types of gate latches are known in the prior art. A typical example of such a gate latch is to be found in U.S. Pat. No. 2,548,367, which issued to C. Harris on Apr. 10, 1951. This patent discloses a crate latching device which utilizes a bracket bent to provide a hinge loop adapted to be attached to a crate cover so that the hinge loop will project beyond the edge of the cover. A swinging link is formed from a wire rod shaped so as to provide a cross bar parallel with the hinge loop. U.S. Pat. No. 2,613,972, which issued to M. Gifford on Oct. 14, 1952 discloses a gate latch for use with a flexible wire gate having a moveable post secured adjacent a stationary fence post. A pivotal toggle linkage is utilized to stretch and secure the gate in a closed position. U.S. Pat. No. 3,891,254, which issued to P. Lile on June 24, 1975, discloses a gate latch for securing the moveable post of a flexible wire gate adjacent a stationary fence post which utilizes a pivotal linkage. A mount is provided for securement to the upper portion of the fence post with an upper portion of the mount projecting above the post. A first L-shaped operating lever is pivotally attached at the free end of its short arm to the upper portion of the mount for swing of the lever about a horizontal axis extending transversely of an associated fence. U.S. Pat. No. 4,683,934, which issued to A. Salsness on Aug. 4, 1987, discloses a gate latch for maintaining a flexible wire gate in a closed position between a pair of stationary posts embedded in the ground. The gate latch includes a support nailed to the upper end of one of the stationary posts and a lever pivotally secured thereto. A U-shaped connector is pivotally secured to the lever and is adapted to be extended over the upper end of a moveable gate post. Pivotal movement of the lever causes the upper end of the gate post to be drawn or pulled toward the stationary post. The lever is locked in a latched position by an over-center mechanism.

While the above mentioned devices are directed to gate latches, none of these devices discloses a gate latch for releasably securing a moveable post of a gate to a stationary fence post including a mounting bracket having a pair of spaced parallel horizontally extending support members pivotally securing a latch bar having an elongated lever extending from a first side and a transverse leg member connected to an opposite side. Additional features of the present invention, not contemplated by the aforesaid prior arts devices include the provision of a transverse leg member having a first end provided with a plurality of apertures and a second opposite end secured to an elongated pivotal strut which terminates in a ring member dimensioned to be received over a top end of a moveable gate post. Inasmuch as the art is relatively crowded with respect to these various types of gate latches, it can be appreciated that there is a continuing need for and interest in improvements to such gate latches, and in this respect, the present invention addresses this need and interest.

SUMMARY OF THE INVENTION

In view of the foregoing disadvantages inherent in the known types of gate latches now present in the prior art, the present invention provides an improved gate latch. As such, the general purpose of the present invention, which will be described subsequently in greater detail, is to provide a new and improved gate latch which has all the advantages of the prior art gate latches and none of the disadvantages.

To attain this, a representative embodiment of the concepts of the present invention is illustrated in the drawings and makes use of a gate latch for use in releasably securing a moveable post of a gate to a stationary fence post which includes a first ring member secured at a bottom end of the stationary fence post and dimensioned for insertion of a bottom end of the moveable gate post. A mounting is secured on a vertically extending sidewall of the stationary post and a pair of spaced parallel horizontally extending support members extend laterally outwardly therefrom. The body portion of a latch bar is pivotally mounted between the support members. The latch bar includes an elongated lever extending from a first side of the body portion and a transverse leg member connected to an opposite side of the body portion. A fist end of the transverse leg member is provided with a plurality of apertures and an elongated strut is pivotally secured at an opposite side of the transverse leg member. A second member is secured on a distal end of the elongated strut and is dimensioned to be received over a top end of the moveable gate post. A retaining pin is provided for insertion through one of the apertures in the transverse leg member to retain the latch bar in a latched position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved gate latch which has all the advantages of the prior art gate latches and none of the disadvantages.

It is another object of the present invention to provide a new and improved gate latch which may be easily and efficiently manufactured and marketed.

It is a further object of the present invention to provide a new and improved gate latch which is of a durable and reliable construction.

An even further object of the present invention is to provide a new and improved gate latch which is susceptible of a low cost of manufacture with regard to both materials and labor, and which accordingly is then susceptible of low prices of sale to the consuming public, thereby making such gate latches economically available to the buying public.

Still yet another object of the present invention is to provide a new and improved gate latch which utilizes a pivotal latch bar having an elongated manually manipulated lever for stretching and closing a wire gate.

Yet another object of the present invention is to provide a new and improved gate latch which includes dual lever portion for providing a compound mechanical advantage for stretching and closing a flexible wire gate.

Even still another object of the present invention is to provide a new and improved gate latch which allows inexpensively constructed flexible barbed wire gates to be easily closed and securely maintained in a closed position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
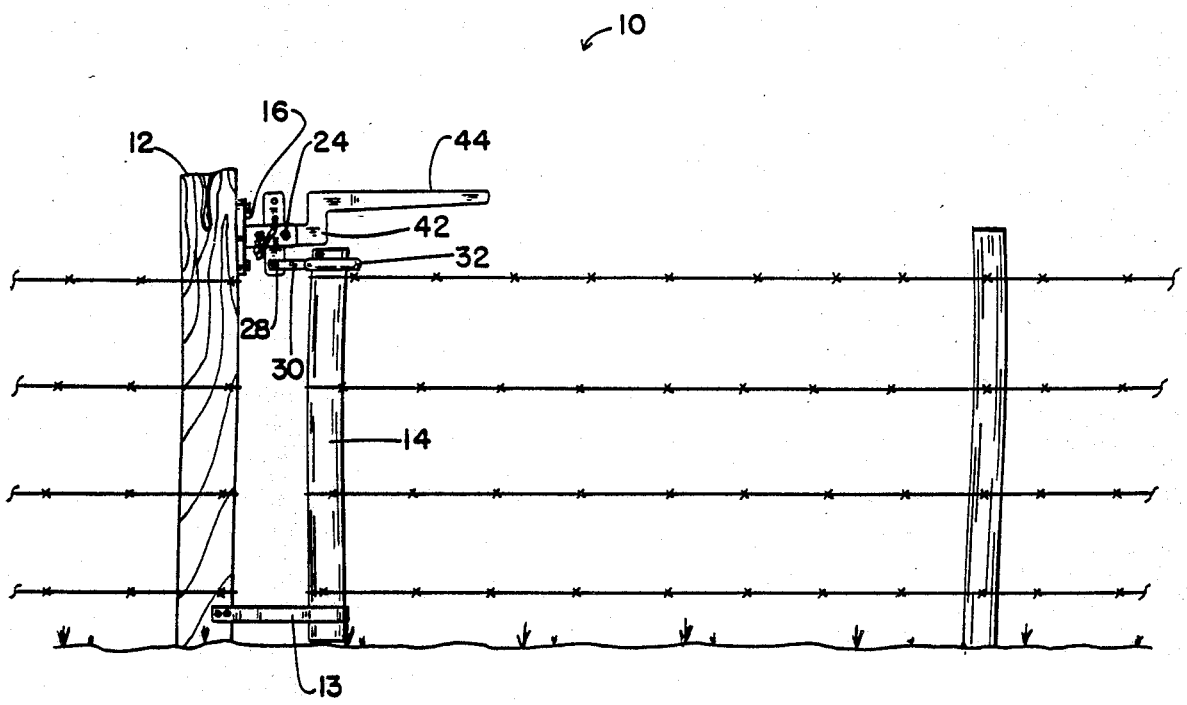
FIG. 1 is a side view of a barbed wire gate including the gate latch of the present invention.

With reference now to the drawings, and in particular to FIG. 1 thereof, a new and improved gate latch embodying the principles and concepts of the present invention and generally designated by the reference numeral 10 will be described.

More specifically, it will be noted that the first embodiment 10 of the invention includes a stationary fence post 12 having a first a ring member 13 secured at a bottom end thereof and dimensioned for insertion of a bottom end of the moveable gate post 14. A mounting bracket 16 secures the gate latch mechanism 10 to a vertical sidewall of the stationarY fence 12 adjacent the upper end thereof. The gate latch mechanism 10 includes a latch bar body portion 42 pivotally mounted by a pin 24. An elongated lever 44 extends from a first side of the body portion 42 for manually latching or unlatching the gate. A strut 30 is mounted by pivot pin 28 and has a ring member 32 secured at an end thereof. The second ring member 32 is dimensioned to be received over a top end of the moveable gate post 14.

Figure 2:
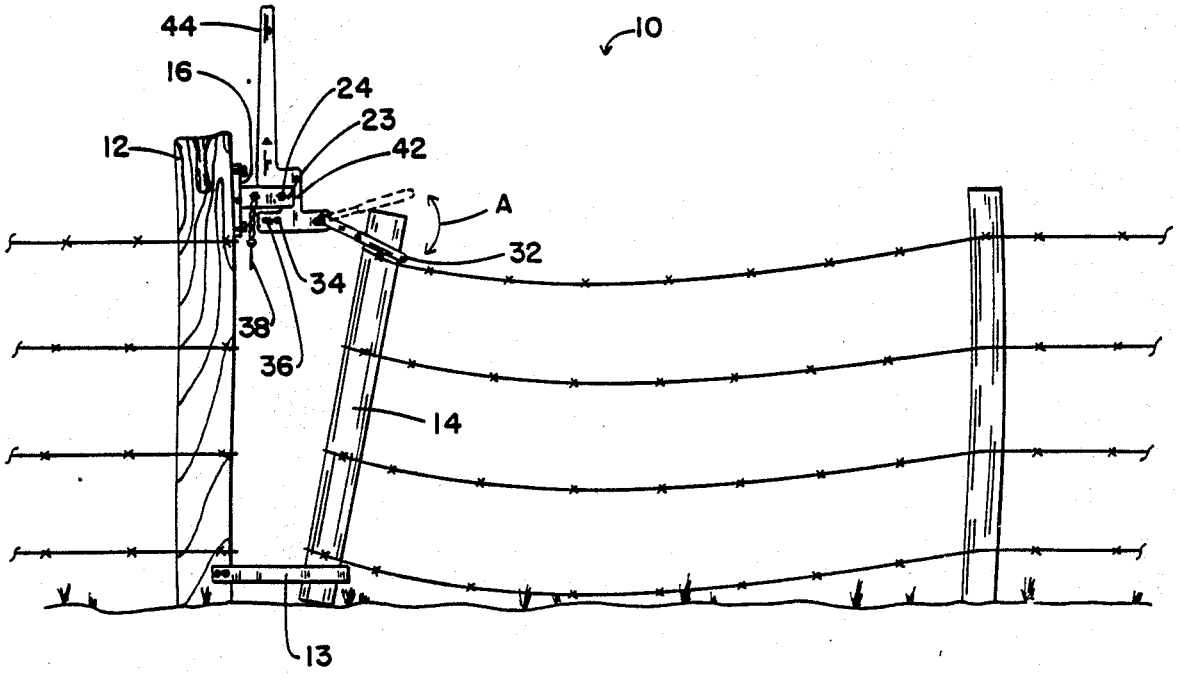
FIG. 2 is a side view illustrating the manner of operation of the gate latch of the present invention.

FIG. 2 illustrates the manner of the opening and closing the gate utilizing the latch 10 of the present invention. The lever 44 is illustrated in an unlatched position in which the tension on the wire gate is released, allowing the second ring member 32 to be placed over or removed from the top end of the post 14. The retaining pin 38 is dimensioned to be inserted in one of the apertures 34 and 36 provided at a first end of a transverse leg secured to the body portion 42.

Figure 3:
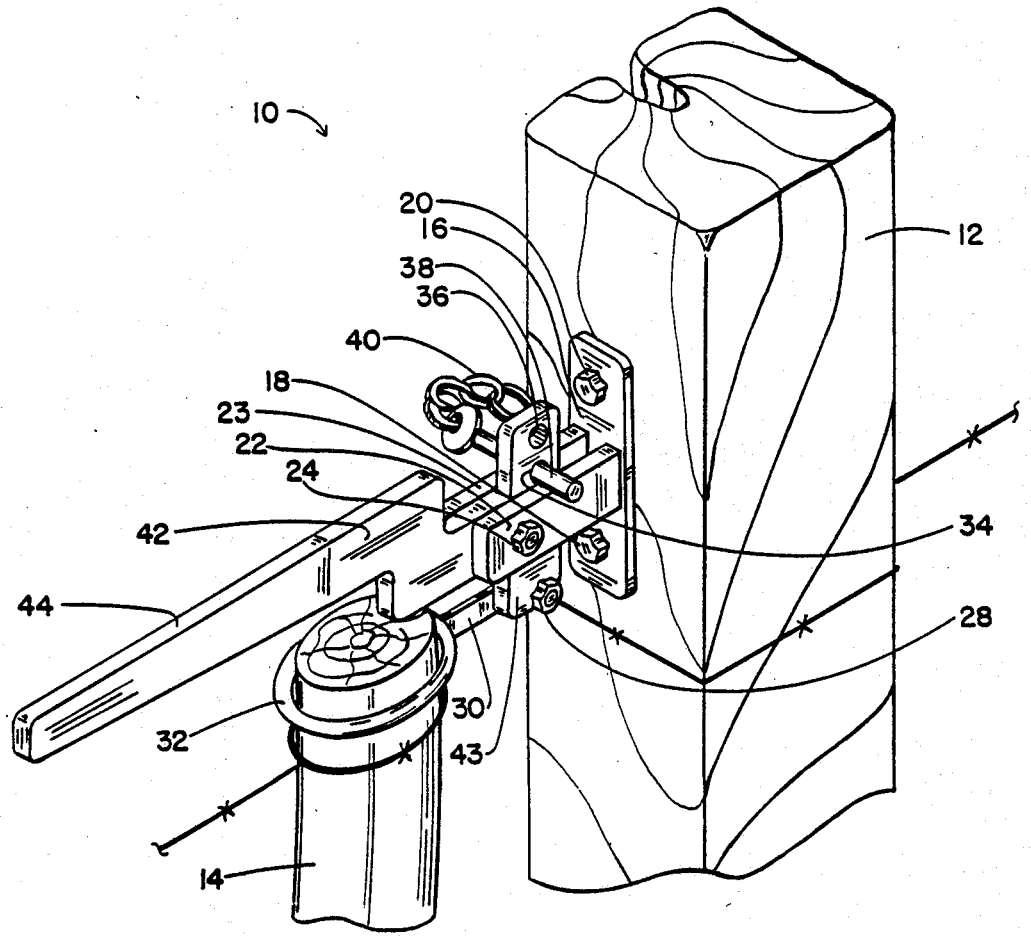
FIG. 3 is a perspective view illustrating the gate latch of the present invention in a latched position.

FIG. 3 is perspective view which further illustrates the construction of the latch 10 of the present invention. The mounting bracket 16 is secured by conventional threaded fasteners 18 and 20 on the vertical sidewall of the post 12. A pair of spaced parallel horizontally extending support members 22 and 23 each have a first end connected with the mounting bracket 16. The body portion 42 of the latch bar is received between the support members 22 and 23 and is pivotally mounted by a pivot pin 24. The elongated lever 44 extends from a first side of the body portion 42 for manually pivoting the latch bar. A transverse leg member 43 is connected to an opposite side of the body portion 42 and extends perpendicular to the lever 44. A first end of the transverse leg member 43 is provided with a pair of apertures 34 and 36 which are dimensioned for insertion of a retaining pin 38 to maintain the latch in the illustrated latched position. The retaining pin 38 is secured by a chain 40 to the mounting bracket 16. An elongated strut 30 is secured by a pivot bolt 28 at a second opposite end of the transverse leg 43. A second ring member 32 is secured on a free end of the strut 30 and is dimensioned to be received over a top end of the moveable gate post 14. The latch bar is moveable between an unlatched position in which the lever 44 extends in a generally vertical direction and the transverse leg member 43 extends in a generally horizontal direction and a latched position in which the lever 44 extends in the illustrated horizontal direction and the transverse leg member 43 extends in the illustrated generally vertical direction with the first end of the transverse leg member 43 received between the horizontally extending support members 22 and 23 and secured by the retaining pin 38.

Figure 4:
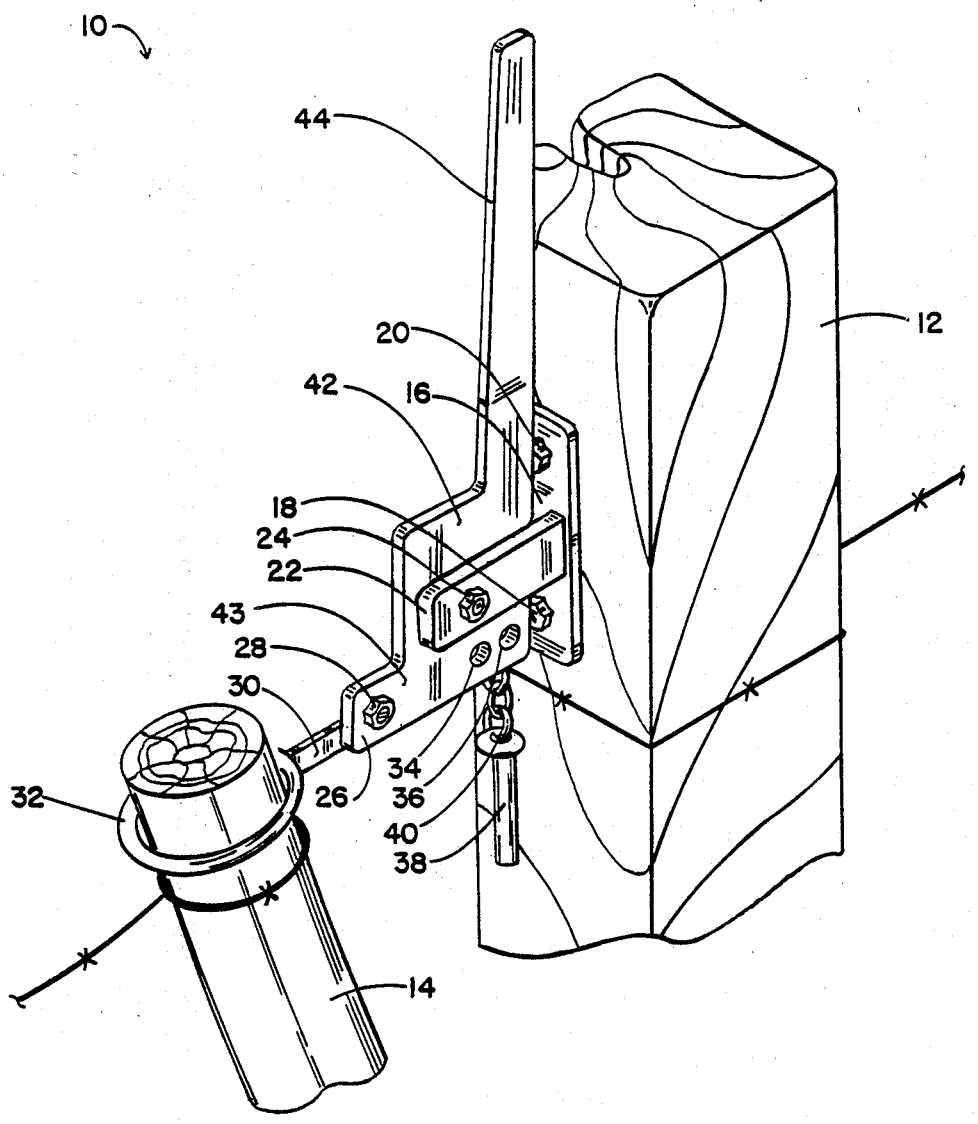
FIG. 4 is perspective view illustrating the gate latch of the present invention in an unlatched position.

FIG. 4 is a perspective view illustrating the gate latch in an unlatched position in which the tension on the flexible wire gate is released, allowing the ring member 32 on the pivotal strut 30 to be placed over or removed from the top end of the post 14.

As may now be understood, the gate latch of the present invention provides a compound mechanical advantage which allows a flexible wire gate to be moved and retained in a closed position with a minimum of inconvenience and effort.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the U.S. is as follows:

1. A gate latch for use in releasably securing a moveable post of a gate to a stationary fence post, comprising:

a first ring member secured at a bottom end of the stationary fence post and dimensioned for insertion of a bottom end of the moveable gate post;

a mounting bracket secured on a vertically extending sidewall of the stationary post, adjacent an upper end thereof;

a pair of spaced parallel horizontally extending support members each having a first end connected with said mounting bracket;

a latch bar having a body portion received between said horizontally extending support members;

a pivot pin mounting said latch bar for pivotal movement between said horizontally extending support members;

an elongated lever extending from a first side of said latch bar body portion for manually pivoting said latch bar;

a transverse leg member connected to an opposite side of said latch bar body portion, said transverse leg member extending perpendicular to said lever;

a first end of said transverse leg member provided with a plurality of apertures;

an elongated strut pivotally secured at a second and opposite end of said transverse leg member;

a second ring member secured on said elongated strut and dimensioned to be received over a top end of the moveable gate post;

said latch bar moveable between an unlatched position in which said lever extends in a generally vertical direction and said transverse leg member extends in a generally horizontal direction and a latched position in which said lever extends in a generally horizontal direction and said transverse leg member extends in a generally vertical direction partially between said horizontally extending support members, with said first end of said transverse leg member disposed above said horizontally extending support members; and a retaining pin secured by a chain to said mounting bracket and dimensioned for insertion through one of said plurality of apertures in said first end of said transverse leg member and for abutment with said horizontally extending support members to retain said latch bar in said latched position.

* * * * *